US005379700A

United States Patent [19]

Theurer

[11] Patent Number: 5,379,700

[45] Date of Patent: Jan. 10, 1995

[54] TWO MACHINE ARRANGEMENT FOR TRACK TAMPING IN SWITCHES HAVING TRACK LIFTING UNITS MOUNTED ONLY ON FIRST MACHINE

[75] Inventor: Josef Theurer, Vienna, Austria

[73] Assignee: Franz Plasser Bahnbaumaschinen-Industriegesellschaft M.B.H., Vienna, Austria

[21] Appl. No.: 177,423

[22] Filed: Jan. 5, 1994

[30] Foreign Application Priority Data

Jan. 27, 1993 [AT] Austria ..... A 131/93

[51] Int. Cl.[6] ..... E01B 27/17; E01B 27/11

[52] U.S. Cl. ..... 104/7.2; 104/12

[58] Field of Search ..... 104/7.2, 12

[56] References Cited

U.S. PATENT DOCUMENTS

| | | | |
|---|---|---|---|
| 3,494,297 | 2/1970 | Plasser et al. . | |
| 3,744,428 | 7/1973 | Plasser et al. | 104/12 |
| 4,905,604 | 3/1990 | Theurer | 104/12 X |
| 4,947,757 | 8/1990 | Theurer | 104/12 X |
| 5,007,349 | 7/1991 | Theurer | 104/12 |
| 5,031,542 | 4/1991 | Theurer | 104/12 |

*Primary Examiner*—Robert J. Oberleitner
*Assistant Examiner*—S. Joseph Morano
*Attorney, Agent, or Firm*—Collard & Roe

[57] ABSTRACT

A mobile track tamping machine arrangement comprises a first machine and a second machine, each machine comprising a self-propelled elongated machine frame supported on undercarriages running on the track, the first machine preceding the second machine in the operating direction and the machine frame of the first machine being longer than that of the second machine. Vertically adjustable track tamping tool units are mounted on each machine frame, the tamping tool units mounted on the longer machine frame being transversely adjustable sideways beyond the longer machine frame, and a detachable coupling connects facing ends of the machine frames. The arrangement further comprises a track leveling and lining unit operable to correct the track position, a leveling and lining reference system controlling the operation of the track leveling and lining unit, a vertically and transversely adjustable auxiliary rail lifting device mounted on the longer machine frame for engaging a rail of a branch track adjacent the track, a respective operator's cab mounted on the longer machine frame immediately ahead of, and behinds the transversely adjustable tamping tool unit, and an operator's cab at an end of each machine opposite to the facing ends of the machine frames.

9 Claims, 2 Drawing Sheets

TWO MACHINE ARRANGEMENT FOR TRACK TAMPING IN SWITCHES HAVING TRACK LIFTING UNITS MOUNTED ONLY ON FIRST MACHINE

BACKGROUND OF THE INVENTION

1. Field of the Invention

The present invention relates to a mobile track tamping machine arrangement comprising a first machine and a second machine, each machine comprising an elongated machine frame supported on undercarriages running on the track, a drive means for moving the machine frame in an operating direction along the track, the first machine preceding the second machine in the operating direction, and vertically adjustable track tamping tool units mounted on each machine frame, a detachable coupling connecting facing ends of the machine frames, a track leveling and lining unit operable to correct the track position, and a leveling and lining reference system controlling the operation of the track leveling and lining unit.

2. Description of the Prior Art

Such a mobile track leveling, lining and tamping machine arrangement has been disclosed in U.S. Pat. No. 3,744,428. This machine arrangement is comprised of two tamping machines which are linked together. Each machine is equipped with a tamping head for simultaneously tamping two successive ties so that four ties may be simultaneously tamped. To enable the two machines to operate independently, the coupling linking the machines to each other may be detached. This machine arrangement cannot be used for tamping track switches.

U.S. Pat. No. 4,947,757 discloses a switch tamping machine arrangement comprised of two tamping machines. One of the machines operates on the main track while the other machine operates on the branch track of the switch. The two machines operate in tandem and are connected by controls for synchronous operation of the track lifting units. The proper positioning of the two machines is time-consuming, and it has been found that the shorter ones of the long ties of the switch cannot be synchronously tamped because of a lack of space.

U. S. Pat. No. 3,494,297 discloses another type of track tamping machine arrangement comprised of two tamping machines linked together. It has no switch tamping capacity.

U. S. Pat. No. 5,031,542 discloses a tamping machine for use in tangent and switch track sections. For use in tamping long ties in switches, the machine has four transversely adjacently arranged tamping tool heads which are transversely adjustable independently of each other. The switch may be lifted in the area of the long ties by a track lifting unit and an auxiliary rail lifting device arranged for engaging a rail of the branch track.

U.S. Pat. No. 5,007,349 describes a tamping tool head with four transversely adjustable tamping tool units independently displaceable sideways beyond the machine frame by drives connected thereto.

SUMMARY OF THE INVENTION

It is the primary object of this invention to provide a track tamping machine arrangement of the first-described type, which may be operated in tangent and switch track sections with a high tamping capacity and great accuracy of track correction.

The above and other objects are accomplished according to one aspect of the invention with a mobile track tamping machine arrangement comprising a first machine and a second machine, each machine comprising an elongated machine frame supported on undercarriages running on the track, a drive means for moving the machine frame in an operating direction along the track, the first machine preceding the second machine in the operating direction and the machine frame of the first machine being longer than that of the second machine, and vertically adjustable track tamping tool units mounted on each machine frame, the tamping tool units mounted on the longer machine frame being transversely adjustable beyond the longer machine frame. A detachable coupling connects facing ends of the machine frames. The arrangement further comprises a track leveling and lining unit operable to correct the track position, a leveling and lining reference system controlling the operation of the track leveling and lining unit, an auxiliary rail lifting device mounted on the longer machine frame for engaging a rail of a branch track adjacent the track, the auxiliary rail lifting device being adjustable for vertical and transverse adjustment thereof, drive means for transversely adjusting the tamping tool head on the longer machine frame and the auxiliary rail lifting device, a respective operator's cab mounted on the longer machine frame immediately ahead of, and behind, the transversely adjustable tamping tool units, and an operator's cab at an end of each machine opposite to the facing ends of the machine frames.

This arrangement enables switches to be tamped optimally by separately using both machines with maximum operating efficiency. Advantageously, the first machine may be equipped for optimal tamping of tangent, i.e. the main, track while the second machine, which may be called an auxiliary tamping machine, is used only for tamping of the switch and may accordingly be very simply constructed with a short wheel base, single-axle bogies and a small tamping tool head. Switch tamping with this machine arrangement is substantially improved because, after the switch has been accurately leveled by operation of the track leveling and lining unit as well as the auxiliary lifting device, the switch can be fixed in its leveled position with the first machine in a relatively fast tamping operation by centering its tamping heads over the two outer rails of the switch. Thereupon, the switch tamping may be completed with the second machine without requiring further lifting because the switch has been brought to the desired level in the first operating stage. The first machine, which may be called the main tamping machine, can then be used immediately for continuing efficient tamping of the tangent track succeeding the switch. Because both ends of the machine arrangement have operator's cabs, it may be moved as a unit in both directions.

Thus, in addition to an increase in tamping capacity, the machine arrangement of the present invention makes it possible to fix the long ties of the track switch in a single lifting stage. Furthermore, the switch and the succeeding tangent track section may be tamped in a single operating stage, avoiding the disadvantageous formation of a ramp therebetween.

Preferably, the machine frame of the first machine is at least twice as long as the machine frame of the second machine, the undercarriages supporting the machine frame of the first machine are swivel trucks and the undercarriages supporting the machine frame of the second machine are single-axle bogies. In this way, the machine arrangement functions with a conventional tamping machine as a main machine and an auxiliary machine for completing the switch tamping. This auxiliary machine may be structurally very simple and have only a small tamping tool head and no track lifting unit.

If the tamping tool unit mounted on the machine frame of the second machine is transversely adjustable for tamping in switches and drive means are provided for transversely adjusting these tamping tool units, the remaining tamping in the switch can be effected without difficulty with the second machine.

According to preferred embodiments of the tamping machine arrangement, the ends of the machine frame of the first machine are supported by respective ones of the undercarriages, and the arrangement further comprises a carrier frame arranged between the undercarriages and supporting the transversely adjustable tamping tool units and the track leveling and lining unit, and a drive for longitudinally displacing the carrier frame relative to the machine frame of the first machine. A swivel truck supports a rear end of the carrier frame, in the operating direction, on the track, and a bearing longitudinally displaceably mounts a front end of the carrier frame, in the operating direction, on the machine frame of the first machine. Furthermore, the operator's cab behind the tamping tool units on the longer machine frame are mounted at the rear of the carrier frame. A third machine frame may be linked to an end of the longer machine frame opposite the facing ends, the operator's cab of the first machine being mounted on the third machine frame, a pivotal coupling linking one end of the third machine to the longer machine frame and an undercarriage supporting an end of the third machine frame opposite the one end on the track. In this way, the first machine may be a universal continuously operating tamping machine capable of tamping heavy switch and tangent track sections useful for tamping the tangent track section immediately succeeding the switch section.

According to another aspect, this invention provides a method of tamping a track switch comprising a main track and a branch track, each track comprising two rails supported on long ties in the track switch, with a mobile track tamping machine arrangement comprising a first machine and a second machine, each machine comprising an elongated machine frame supported on undercarriages running on the track, the first machine preceding the second machine in the operating direction, and a vertically adjustable track tamping tool unit mounted on each machine frame, the tamping tool units mounted on the machine frame of the first machine being transversely adjustable beyond said machine frame, and a detachable coupling connecting facing ends of the machine frames. This tamping method comprises a sequence of steps including detaching the coupling to separate the machines, transversely adjusting the tamping tool units of the first machine along the long ties of the track switch to center the tamping tool units over respective ones of the rails of the main and branch tracks for tamping, correcting the position of the track switch, and tamping the corrected track switch with the centered tamping tool heads. In a second operating stage, remaining portions along the long ties not previously tamped are tamped with the tamping tool unit of the second machine.

BRIEF DESCRIPTION OF THE DRAWING

The above and other objects, advantages and features of the invention will become more apparent from the following detailed description of a now preferred embodiment, taken in conjunction with the accompanying, partly schematic drawing wherein.

DETAILED DESCRIPTION OF THE PREFERRED EMBODIMENT

Figure 1:
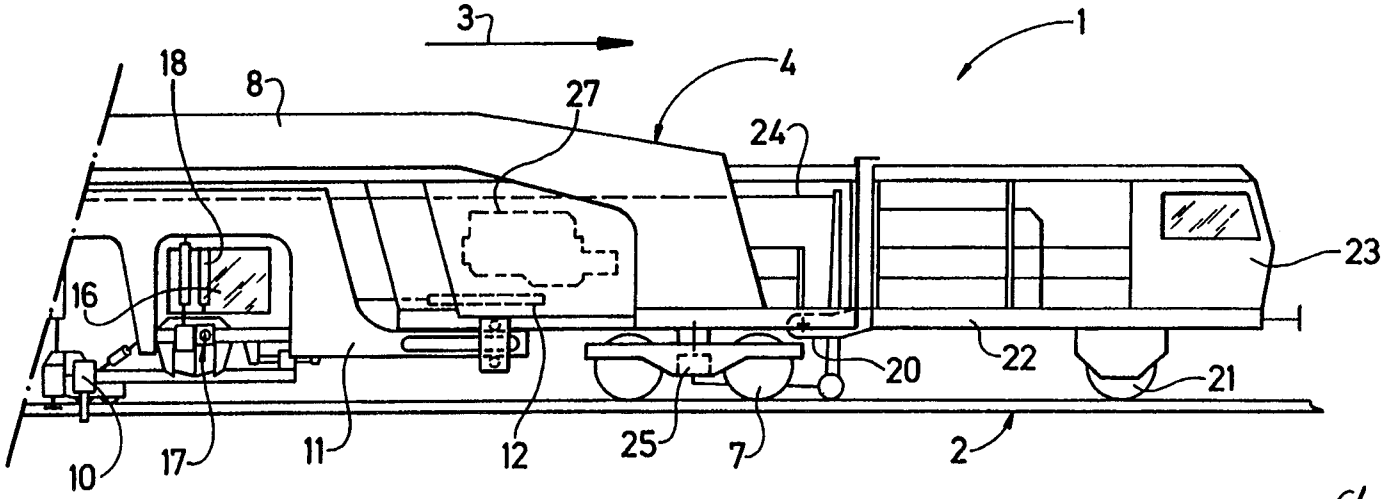
FIG. 1 is a side elevational view of the front half, in the operating direction, of the first machine of the tamping machine arrangement.
Figure 2:
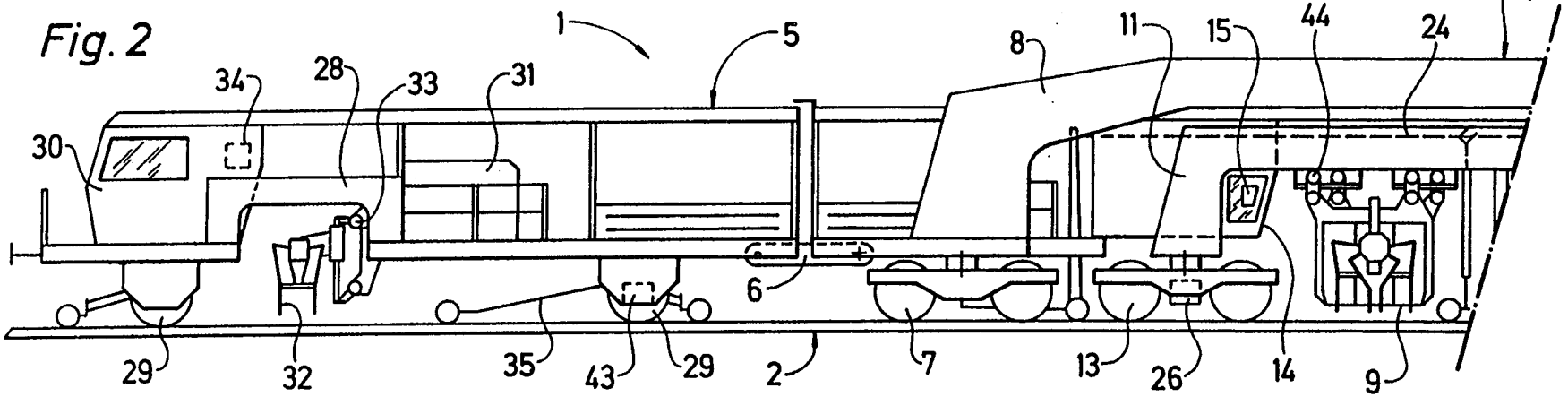
FIG. 2 is a like view of the remaining rear of the tamping machine arrangement.

FIGS. 1 and 2 show mobile machine arrangement 1 for tamping track 2 and comprises first or main machine 4 and second or auxiliary machine 5. Each machine comprises elongated machine frame 8, 28 supported on undercarriages 7, 13, 29 running on track 2, and drive means 25, 26, 43 for moving machine frame 8, 28 in an operating direction indicated by arrow 3 along the track. First machine 4 precedes second machine 5 in the operating direction and machine frame 8 of first machine 4 is longer than that of second machine 5. A vertically adjustable track tamping tool head 9, 32 is mounted on each machine frame, tamping tool head 9 mounted on longer machine frame 8 having four transversely adjustable tamping tool units independently displaceable sideways beyond the longer machine frame by drive means 44, as fully described in U.S. Pat. No. 5,007,349. Detachable coupling 6 connects facing ends of machine frames 8, 28, track leveling and lining unit 10 is operable to correct the track position, leveling and lining reference system 24 controls the operation of the track leveling and lining unit, and auxiliary rail lifting device 17 is mounted on longer machine frame 8 for engaging a rail of branch track 37 adjacent main track 38, the auxiliary rail lifting device being adjustable for vertical and transverse adjustment thereof by drive means 18. All these structures and their functions are conventional.

Respective operator's cab 14, 16 is mounted on longer machine frame 8 immediately ahead of, and behind, the tamping tool head 9, and operator's cab 23, 30 is arranged at an end of each machine 4, 5 opposite to the facing ends of the machine frames. Machine frame 8 of first machine 4 is preferably at least twice as long as machine frame 28 of second machine 5. Furthermore, the undercarriages supporting machine frame 8 of first machine 4 are swivel trucks 7 and the undercarriages supporting machine frame 28 of second machine 5 are single-axle bogies 29 spaced apart a distance of about 7.5 m. Tamping tool head 32 with reciprocable pairs of tamping tools is mounted between the single-axle bogies and is mounted on machine frame 28 of second machine 5 for vertical adjustment and for transverse adjustment by drive 33 for tamping in switches.

In the illustrated embodiment, the ends of machine frame 8 of first machine 4 are supported by respective undercarriages 7, 7, and the arrangement further comprises carrier frame 11 arranged between the undercarriages and supporting the tamping tool head 9 and track leveling and lining unit 10. Drive 12 is arranged for longitudinally displacing carrier frame 11 relative to machine frame 8 of first machine 4. Swivel truck 13 supports a rear end of carrier frame 11, in the operating direction, on track 2, and a bearing longitudinally displaceably mounts a front end of the carrier frame, in the operating direction, on the machine frame of the first machine. This type of continuously operating tamping machine also is conventional.

As shown in FIG. 2, operator's cab 14 on longer machine frame 8 is mounted at the rear end of carrier frame 11 and houses central control 15. Operator's cab 16 (FIG. 4) is mounted immediately ahead of leveling and lining unit 10, in the operating direction, on carrier frame 11 and also houses a control panel. Auxiliary rail lifting device 17 is vertically adjustably connected to carrier frame 11 by drive 18 immediately ahead of leveling and lining unit 10. This structure will be described in more detail hereinafter in connection with FIG. 4.

As shown in FIG. 1, a third machine frame 22 is linked to an end of longer machine frame 8 opposite the facing ends of machine frames 8, 28 detachably linked together by coupling 6. Operator's cab 23 of first machine 4 is mounted on the third machine frame, a pivotal coupling 20 linking one end of third machine frame 22 to longer machine frame 8 and undercarriage 21 supporting an end of the third machine frame opposite the one end on the track. First machine 4 also carries central energy source 27 supplying power to the various drives.

Auxiliary machine 5, which is detachably coupled to main machine 4, is comprised essentially of short machine frame 28 supported by single-axle bogies 29 on track 2 and carrying operator's cab 30 at its rear end, which houses control 34, and vertically and transversely adjustable tamping unit 32. Machine 5 has its own energy source 31 as well as a drive 43 for independently propelling the machine. A level reference system comprised of three measuring carriages 35 controls the level of track 2.

Figure 4:
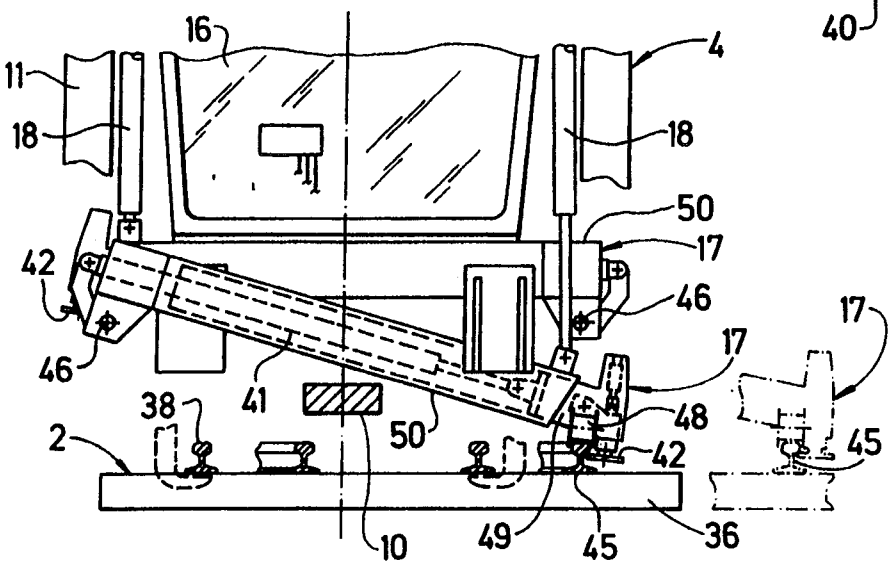
FIG. 4 is an enlarged end view showing the auxiliary lifting device.

As shown in FIG. 4, two auxiliary rail lifting devices 17 are arranged on carrier frame 11 immediately adjacent each other in the longitudinal direction of the machine arrangement. Each track lifting device is an arm which is telescopingly extensible by drive 41 in a transverse direction. Each device has a clamping device 42 at a free end thereof for engaging and gripping rail 45 of track switch section 36, and is pivoted at its opposite end to carrier frame 11 for pivoting about axis 46 extending in the longitudinal direction. Drive 18 links the free arm end to carrier frame 11 for vertically adjusting the lifting device. The clamping device may be transversely adjusted by a suitable drive and cooperates with double-flanged wheel 48 running on the head of rail 45, clamping device 42 and wheel 48 being affixed to inner tube 49 of the lifting device arm which is telescopingly engaged in outer tube 50, to which lifting drive 18 is linked. The gripping engagement of rail 45 by lifting device 17 is shown in phantom lines.

Figure 3:
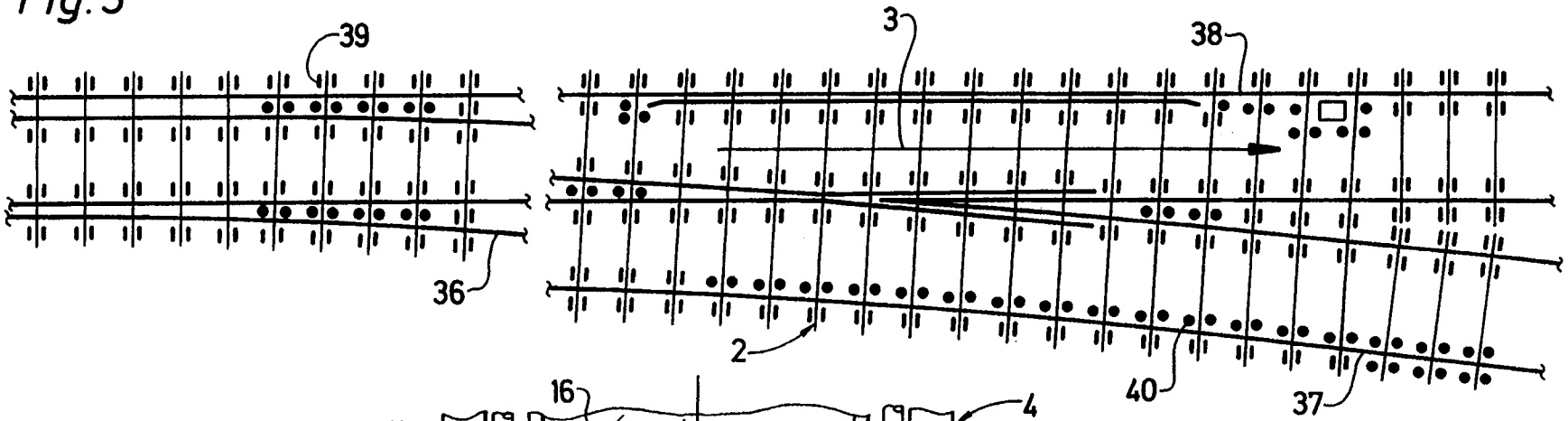
FIG. 3 is a diagrammatic top view of a track switch section, schematically indicating the tamping zones.

FIG. 3 shows switch section 36 of track 2 comprised of main track 38 and branch track 37. The intersections of the rails and ties, where the tracks are supported by the ballast, which are tamped first by tamping tool units 9 of machine 4 when it moves in the operating direction indicated by arrow 3 are designated 39. During this first operating stage, only first machine 4 moves on main track 38, second machine 5 having been uncoupled. Immediately behind first machine 4, in the operating direction, auxiliary machine 5 can be advanced to tamp the previously untamped track support points designated 40. For this purpose, machine 5 is first advanced along branch track 37, is then moved back to the main track and then advanced in a further operating stage along main track 38 to complete the tamping of the switch. Since switch section 36 has been leveled by operation of the track correction mechanism on main machine 4, no further track lifting is needed during tamping by auxiliary machine 5. While the auxiliary machine tamps in switch section 36, main machine 4 may be advanced along the main track for tamping.

Thus, this machine arrangement provides a method of tamping track switch 36 comprising main track 38 and branch track 37, each track comprising two rails supported on long ties in the track switch, which method comprises a sequence of steps including detaching coupling 6 to separate machines 4 and 5, transversely adjusting tamping tool units 9 of first machine 4 along the long ties of track switch 36 to center the tamping tool units over respective ones of the rails of the main and branch tracks for tamping, correcting the position of the track switch, and tamping the corrected track switch with centered tamping tool units 9. In a second operating stage, remaining portions 40 along the long ties not previously tamped are tamped with tamping tool unit 32 of second machine 5.

What is claimed is:

1. A mobile track tamping machine arrangement comprising (a) a first machine and a second machine, each machine comprising (1) an elongated machine frame supported on undercarriages running on the track, (2) a drive means for moving the machine frame in an operating direction along the track, the first machine preceding the second machine in the operating direction and the machine frame of the first machine being longer than that of the second machine, and (3) vertically adjustable track tamping tool units mounted on each machine frame, the tamping tool units mounted on the longer machine frame being transversely adjustable sideways beyond the longer machine frame, (b) a detachable coupling connecting facing ends of the machine frames, (c) a track leveling and lining unit operable to correct the track position, (d) a leveling and lining reference system controlling the operation of the track leveling and lining unit, (e) an auxiliary rail lifting device mounted on the longer machine frame for engaging a rail of a branch track adjacent the track, the auxiliary rail lifting device being adjustable for vertical and transverse adjustment thereof, (f) drive means for transversely adjusting the tamping tool units on the longer machine frame and the auxiliary rail lifting device, (g) a respective operator's cab mounted on the longer machine frame immediately ahead of, and behind, the transversely adjustable tamping tool unit, and (h) an operator's cab at an end of each machine opposite to the facing ends of the machine frames.

2. The mobile track tamping machine arrangement of claim 1, wherein the machine frame of the first machine is at Least twice as long as the machine frame of the second machine.

3. The mobile track tamping machine arrangement of claim 1, wherein the undercarriages supporting the machine frame of the first machine are swivel trucks and the undercarriages supporting the machine frame of the second machine are single-axle bogies.

4. The mobile track tamping machine arrangement of claim 1, wherein the tamping tool unit mounted on the machine frame of the second machine is transversely adjustable for tamping in switches, further comprising drive means for transversely adjusting said tamping tool heads.

5. The mobile track tamping machine arrangement of claim 1, wherein the ends of the machine frame of the first machine are supported by respective ones of the undercarriages, further comprising a carrier frame arranged between the undercarriages and supporting the transversely adjustable tamping tool units and the track leveling and lining unit, and a drive for longitudinally displacing the carrier frame relative to the machine frame of the first machine.

6. The mobile track tamping machine arrangement of claim 5, further comprising a swivel truck supporting a rear end of the carrier frame, in the operating direction, on the track, and a bearing for longitudinally displaceably mounting a front end of the carrier frame, in the operating direction, on the machine frame of the first machine.

7. The mobile track tamping machine arrangement of claim 6, wherein one of the operator's cabs on the longer machine frame is mounted at a rear end of the carrier frame.

8. The mobile track tamping machine arrangement of claim 1, further comprising a third machine frame linked to an end of the longer machine frame opposite the facing ends, the operator's cab of the first machine being mounted on the third machine frame, a pivotal coupling linking one end of the third machine to the longer machine frame and an undercarriage supporting an end of the third machine frame opposite the one end on the track.

9. A method of tamping a track switch comprising a main track and a branch track, each track comprising two rails supported on long ties in the track switch, with a mobile track tamping machine arrangement comprising a first machine and a second machine, each machine comprising an elongated machine frame supported on undercarriages running on the track, the first machine preceding the second machine in the operating direction, and vertically adjustable track tamping tool units mounted on each machine frame, the tamping tool units mounted on the machine frame of the first machine being transversely adjustable sideways beyond said machine frame, and a detachable coupling connecting facing ends of the machine frames, which tamping method comprises a sequence of steps including (a) detaching the coupling to separate the machines, (b) transversely adjusting the tamping tool units of the first machine along the long ties of the track switch to center the tamping tool units over respective ones of the rails of the main and branch tracks for tamping, (c) correcting the position of the track switch, (d) tamping the corrected track switch with the centered tamping tool heads, and (e) in a second operating stage, tamping remaining portions along the long ties not previously tamped with the tamping tool heads of the second machine.

* * * * *